US008480783B2

(12) United States Patent
Okamoto et al.

(10) Patent No.: US 8,480,783 B2
(45) Date of Patent: Jul. 9, 2013

(54) SINTERED POROUS METAL BODY AND A METHOD OF MANUFACTURING THE SAME

(75) Inventors: Kazutaka Okamoto, Tokai (JP); Masami Taguchi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 169 days.

(21) Appl. No.: 12/840,369

(22) Filed: Jul. 21, 2010

(65) Prior Publication Data

US 2011/0020662 A1 Jan. 27, 2011

(30) Foreign Application Priority Data

Jul. 22, 2009 (JP) ..... 2009-171097

(51) Int. Cl.
*C22C 1/05* (2006.01)
*C22C 21/00* (2006.01)

(52) U.S. Cl.
USPC ..... 75/249; 75/235; 75/236; 75/244

(58) Field of Classification Search
USPC ..... 75/235, 236, 238, 249; 419/2
See application file for complete search history.

(56) References Cited

U.S. PATENT DOCUMENTS

| | | | | |
|---|---|---|---|---|
| 4,430,294 | A * | 2/1984 | Tracey | 419/2 |
| 4,623,388 | A * | 11/1986 | Jatkar et al. | 75/232 |
| 5,736,092 | A * | 4/1998 | Apte et al. | 264/432 |
| 6,926,969 | B2 * | 8/2005 | Bohm et al. | 428/566 |
| 7,087,202 | B2 * | 8/2006 | Liu et al. | 419/32 |
| 7,357,976 | B2 * | 4/2008 | Yamamura et al. | 428/312.2 |
| 7,517,492 | B2 * | 4/2009 | Liu | 419/57 |
| 2005/0281699 | A1 * | 12/2005 | Kang et al. | 419/2 |

FOREIGN PATENT DOCUMENTS

| | | |
|---|---|---|
| JP | 07-102330 | 4/1995 |
| JP | 9-510950 | 11/1997 |
| JP | 11-130568 | 5/1999 |
| JP | 2004-156092 | 6/2004 |
| WO | WO 95/26940 | 10/1995 |

OTHER PUBLICATIONS

Y. Y. Zhao et al., A Novel Sintering-Dissolution Process for Manufacturing Al Foams, Scripta mater, 2001, pp. 105-110, vol. 44, No. 1. www.elsevier.com/locate/scriptamat.

Rustum Roy et al., Full sintering of powdered-metal bodies in a microwave filed, Letters to nature, Jun. 17, 1999, pp. 668-670, vol. 399. www.nature.com.

* cited by examiner

*Primary Examiner* — Roy King
*Assistant Examiner* — Ngoclan T Mai
(74) *Attorney, Agent, or Firm* — Volpe and Koenig, P.C.

(57) ABSTRACT

A sintered porous metal body, which has a sintered structure having a volumetric porosity of 10 to 90%, wherein there are at least one powder particles selected from the group consisting of dielectric material powders and semiconductor material powders that absorb energy of electromagnetic wave having a frequency of 300 MHz to 300 GHz among the metal crystalline particles constituting the sintered body, wherein the particles are substantially homogeneously dispersed in the sintered body, and wherein the metal particles are sintered to bond each other to be united to constitute pores. The invention discloses a method of manufacturing the sintered porous metal body.

9 Claims, 4 Drawing Sheets

SINTERED POROUS METAL BODY AND A METHOD OF MANUFACTURING THE SAME

CLAIM OF PRIORITY

This application claims priority from Japanese Patent application serial No. 2009-171097, filed Jul. 22, 2009, the content of which is hereby incorporated by reference into this application.

FIELD OF THE INVENTION

The present invention relates to a sintered porous metal body and a method of manufacturing the same.

BACKGROUND ART

There have been several methods for manufacturing sintered porous metal bodies. Among them a casting method, a foaming method, a burning synthetic method and a powder sintering method have been known. One of powder sintering methods is a spacer method in which a spacer material for forming spaces in a sintered body and metal powder as a base material are mixed, molded and sintered to thereby produce a porous body.

Patent document No. 1 and non-patent document No. 1 disclose aluminum based porous materials. In patent document No. 1, there is disclosed a method of manufacturing a sintered porous metal body, which has excellent impact absorption, featured by preparing a mixture of a powder of aluminum or aluminum alloy and a water soluble spacer material powder, charging the mixture into a vessel, applying a pulsating current to the mixture powder under a compression pressure to sinter the aluminum or aluminum alloy mixture, and dissolving the spacer out from the sintered body with water to thereby obtain a sintered porous body. Further, in patent document No. 1, aluminum powder having a particle size of 3 μm and NaCl powder as a spacer material, having a particle size of 200 to 300 μm are mixed, and the resulting mixture is sintered by applying a pulsating current at 480° C. for 5 minutes under a compression pressure of 20 MPa in a graphite mold to thereby produce a porous aluminum body.

In non-patent document No. 1, aluminum powder having particle size of 450 μm and NaCl powder having a particle size of 300 to 1000 μm as a spacer material are mixed and the mixture is sintered in a steel mold at 680° C. for 180 minutes after molding the mixture under a compression pressure of 200 MPa to produce a porous aluminum body.

Non-patent document No. 2 discloses that though it has been a common knowledge that microwave heating is not useful for heating metal materials because the microwave heating uses dielectric loss of dielectric materials. Heating and sintering of metal powders by the microwave are performed by induction loss or magneto-loss due to a skin effect.

In general, it is said that sintering of aluminum powder is extremely difficult because native oxide (alumina) formed on the surface of the powder is thermally and chemically stable very much. Normally, the native oxide film formed on the metal powder may be reduced and removed by sintering it in a reducing atmosphere, but aluminum oxide or magnesium oxide is not reduced because the oxides have low standard thermo-dynamic quantity.

Non-patent document No. 1 discloses a method for molding powder under a pressure as high as 200 MPa. It is assumed that the native oxide film is destroyed under a shearing force by elastic-deforming the aluminum powder to thereby bring aluminum powder into contact with each other without the native oxide film and accumulate strain energy therein. After a long sintering time, the aluminum powder diffuses each other releasing the strain energy to barely case the powder to be sintered.

However, in case of non-patent document No. 1, aluminum powder (particularly, pure aluminum powder) may enter into gaps of the mold at the time of high pressure molding because of its low hardness and softness, which causes galling or damage to the mold. Since generally employed heating with heaters is conducted in an atmosphere, the article to be heated and the atmosphere as well as furnaces must be heated, which needs a long time for sintering. As a result, crystalline grains in the aluminum powder grow coarse in size to lessen mechanical strength.

Patent document No. 2 discloses a sintering method in which a material to be sintered selected from the group consisting of ceramics, ceramic composite materials and metallic materials is covered with a layer of granular susceptor, a protecting gas is introduced around the material, and microwave energy is irradiated to the material and the susceptor, wherein the susceptor layer comprises (a) a dominant amount of microwave susceptor material and (b) a small amount of heat resisting mold-separating agent, which is dispersed in the susceptor material or is supplied as a coating on the susceptor.

Patent document No. 3 discloses a composite body in which metal is impregnated into a porous ceramic body, the entire surface of the composite body being covered with a layer of the metal; the porous ceramic body is at least one member selected from the group consisting of silicon carbide, aluminum nitride, silicon nitride, alumina and silica; the metal is aluminum or magnesium; and a porosity of the porous ceramics is porous silicon carbide having porosity of 20 to 50% and the metal is aluminum.

Patent document No. 4 discloses a method of manufacturing a light metal composite body which comprises forming a molding article of porous metal body having a metal alloy layer on the surface thereof wherein silicon carbide particles are dispersed, placing the molded article in a mold, and casting the molded article with molten aluminum alloy.

The pulsating current sintering method comprises filing a mixed powder of aluminum (Al) and sodium chloride (NaCl) in a graphite mold, and heating the mixture with pulsating current while the mixture is compressed in a uni-axial direction to sinter the mixture. Generally, it is said that the pulsating current sintering method can heat the sample effectively to sinter it within a very short period of time.

However, dispersion or fluctuation of characteristics is the problem which is caused by temperature distribution of the sample or carbon mold at the time of sintering so that it is very difficult to obtain a uniform temperature distribution. In addition, the pulsating current sintering method has low productivity because a number of samples are not sintered at one time, which is performed by heating with the conventional heaters, and a size of the samples is limited to a size of the graphite mold, which makes scale-up of the samples difficult.

On the other hand, it is said that when microwave is used, a quick heating, an inner heating or quick sintering is possible by virtue of induction loss or magnetic loss due to skin effect of metal powder. However, if a molding pressure or density is high, molded articles are not an agglomerate of individual powders, but a bulk body in which the individual powders are mechanically bonded.

Microwave is mainly reflected in the surface of the bulk body, part of which heats the surface and its vicinity of the bulk body by virtue of skin effect, but amount of heat generation is small and sintering does not occur. Further, in microwave sintering, it is necessary to increase the compression pressure or density of the molding in order to perform sintering by mutual diffusion while the strain energy of the powders in metal contact with each other is released.

FIG. 1 shows a sintering density of sintered articles of pure aluminum powder that were produced by sintering molded bodies with microwave and heater at 645° C. each having a different density. In this case, pure aluminum powder was not mixed with other materials such as insulating powder (sodium chloride), dielectric powder (silicon carbide) or semiconductor powder (carbon). In this figure, the higher the sintering density, the larger the volume shrinkage by sintering the sintered articles exhibit. In addition, □, Δ and ○ represent the articles produced by heating with heaters and ■, ▲ and ● represent the sintered articles produced by heating with microwave. In case of heating with the heaters, volume shrinkage was not observed even after heating for 60 minutes. This was because the native oxide film hindered sintering.

On the other hand, in case of microwave heating, a volume shrinkage was observed within 10 to 30 minutes, and a remarkable volume shrinkage was observed particularly in molded articles having a molding density of about 70%. This was because if there were gaps in the molded articles, microwave could permeate into the interior of the molded articles so that each powder is heated by virtue of skin effect. That is, since the native oxide layer and its vicinity were preferentially heated than the interior of the powder to assist diffusion between the powder particles.

Accordingly, it is important to control density of molded articles so as to let the microwave permeate into the interior of the molded articles in heating the molded articles of the metal powder.

In powder metallurgy, net-shape or near net-shape is an important feature. Normally, the molding density is 90% or more, and such molded articles cannot be sintered by microwave heating. Thus, in non-patent document No. 2, a susceptor made of SiC, which absorbs microwave to induce heating, is arranged around the articles to effect indirect heating.

Further, since the microwave heating is caused by spontaneous heat generation of the molded articles, an amount of heat depends on shapes of powder or size. In addition, it is said that to secure a constant temperature distribution is extremely difficult because microwave electromagnetic field tends to concentrate at corners of the articles, and the corners are excessively heated than other portions. Moreover, temperature distribution in the interior is very complicated.

PATENT DOCUMENTS (Patent document No. 1) Japanese patent laid-open 2004-156092

(Patent document No. 2) Japanese patent laid-open H09-510950.

(Patent document No. 3) Japanese patent laid-open H11-130568

(Patent document No. 4) Japanese patent laid-open H07-102330

NON-PATENT DOCUMENTS (Non-patent document No. 1) Y. Y. Zhao and D. X. Sun: "A novel sintering-dissolution process for manufacturing Al foams", Scripta Meter. 44 (2001), pp. 105-110

(Non-patent document No. 2) R. Roy, et al "Full sintering of powdered-metal bodies in a microwave field", Nature, 399 (1999), pp. 688-670

SUMMARY OF THE INVENTION

An object of the present invention is to provide a sintered porous metal body having homogeneous and free of fluctuation in quality and a method of manufacturing the same.

The present invention provides a sintered porous metal body having a volume porosity of 10 to 90%, which contains particles selected from the group consisting of dielectric material powder and semiconductor material powder, the particles being able to absorb energy of electromagnetic wave of a frequency of 300 MHz to 300 GHz to generate heat, wherein the particles are substantially homogeneously dispersed in the sintered porous body and the metal particles are sintered to bond each other to unit the porous body.

Further, the present invention provides a method of manufacturing a sintered porous body, which comprises mixing metal powder and at least one member selected from the group consisting of dielectric material powder and semiconductor material powder that are able to absorb energy of electromagnetic wave to generate heat; compression molding the mixture of the powders to obtain a molding having a relative density of 60% or more; and heating and sintering the molding by irradiating it with an electromagnetic wave having a frequency of 300 MHz to 300 GHz to obtain a sintered porous metal body having a porosity of 10 to 90%.

According to the present invention, it is possible to provide sintered porous metal body of being homogeneous and free of fluctuation. It is also possible to mass-produce sintered porous metal bodies in net-shape or near net-shape within a short time. Further, it is possible to provide a method of manufacturing sintered porous metal bodies, which can be easily scaled up.

REFERENCE NUMERALS

Figure 1:
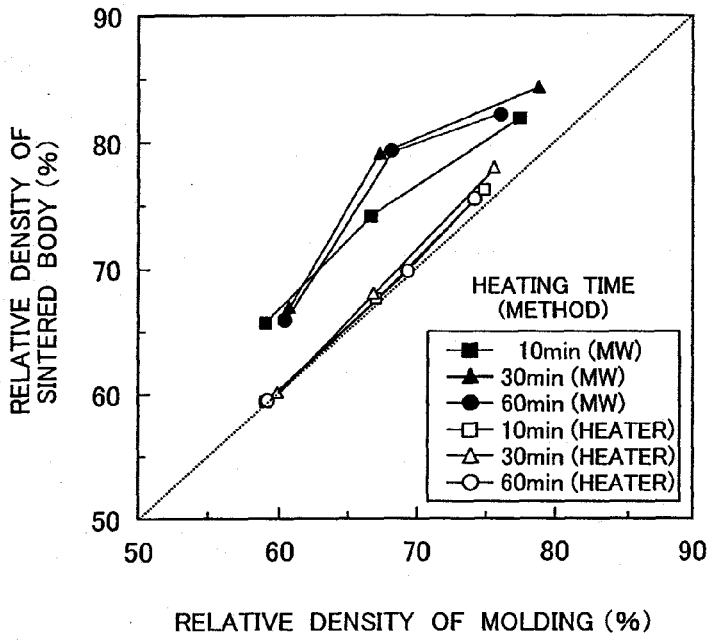
FIG. 1 is a graph showing a relative sintering density with respect to relative molding density of a molding of pure aluminum powder.

1; aluminum skeleton, 2; void, 3; weighing and mixing, 4; molding of powder (powder rolling), 6; porous sheet, 7; sodium chloride powder, 8; silicon carbide, 9; aluminum alloy powder, 10; mixed powder 1, 11; mixed powder 2, 12; hopper, 13; rolling roller, 14; rolled powder, 15; cutting, 16; microwave generator, 18; heat insulator, 19; washing, 20; porous sheet, 21; microwave furnace

DETAILED DESCRIPTION OF PREFERRED EMBODIMENTS

The present invention relates to a sintered porous metal body, which is light and has high rigidity and is suitable for metal based porous materials that are excellent in energy absorption of vibration, electromagnetic wave, sound, heat, etc. Further, the present invention relates to metal based porous body as a precursor of electromagnets, filters, oil impregnated bearings, which is a porous material that can be filled with another material at a later step. In addition, the present invention relates to a method of manufacturing a porous material with desired shape in a short time at a easy method.

An object of the present invention is to mass produce sintered porous metal bodies having a large size, being homogeneous and free of fluctuation in quality in a short time by a molding technique of a net-shape or near-net shape.

The present invention provides a method of manufacture to attain the above object, in paying attention to inter reaction between microwave and the materials. That is, metal powder, insulating material powder and dielectric material powder or semiconductor powder are mixed, and the mixture is molded. Then, the molding is irradiated with electromagnetic wave to heat and sinter it. The insulating material powder is removed during heating or after sintering. If a desired porosity of the sintered porous metal body is natural compacting density (a tap density), the compression molding step or the removing step of the insulating material powder is not necessary.

In the method of manufacturing the sintered porous metal body of the present invention, the step of mixing mixes at least two of the metal powder, insulating material powder and/or dielectric material powder, and semiconductor material powder. In the method of manufacturing the sintered porous metal body of the present invention, the metal powder includes aluminum or aluminum alloy, iron based alloys, copper alloys, nickel based alloys, cobalt based alloys, and the insulating material powder includes sodium chloride or ammonium hydrogen carbonate (the insulating material means one that generates little amount of heat upon absorbing the microwave and that has a function of a spacer to form voids), the dielectric material powder includes silicon carbide, silicon nitride, zirconia, and aluminum nitride, which absorbs microwave and assists to cause the metal powder to be heated and sintered.

The semiconductor material powder includes silicon, boron, and germanium. The semiconductor material powder is less effective to absorb the microwave than the dielectric material powder, but it absorbs microwave magnetic field and generates heat stably to assist heat generation and sintering of the metal powder. If a desired porosity of the sintered porous metal body is a natural compacting density (tap density), the addition of the insulating material powder and its removal are not always necessary.

In the method of manufacturing the sintered porous metal body of the present invention, the molding step is performed by uni-axial compression, powder rolling or powder extrusion at room temperature to prepare a molding having a relative density of 80% or more. However, if the a desired porosity is 80% or more, the compression molding is not always necessary.

In the method of manufacturing the sintered porous metal body of the present invention, a frequency of the electromagnetic wave should be 300 MHz to 300 GHz, and heating with the electromagnetic wave is conducted for 10 to 30 minutes at a temperature lower than the melting point of the metal powder. An atmosphere for the heating is a reduced pressure of 10 Pa or lower, inert gas, nitrogen gas, hydrogen gas or mixture thereof.

In the method of manufacturing the sintered porous metal body of the present invention, the insulating material powder is removed by dissolving it with water.

The sintered porous metal body of the present invention has a structure composed of a metal having porosity, which contains dielectric material powder or semiconductor material powder for absorbing energy of electromagnetic wave to generate heat.

The sintered porous metal body of the present invention is featured by pores of a cubic form. If a desired porosity of the sintered porous metal body is natural compact density (tap density), the addition of the insulating material powder is not always necessary.

The sintered porous metal body of the present invention may be selected from aluminum, iron, copper, nickel, cobalt and their alloys.

The sintered porous metal body may contain silicon carbide, zirconia or aluminum nitride as the dielectric material powder. As the semiconductor material powder, at least one of carbon, silicon, boron and germanium is selected.

In the sintered porous body, an amount of the dielectric material powder is 0.4 to 10 percent by weight (1/250-1/10). The rate of the dielectric material powder corresponds to a case where an amount of the insulating material powder is 50 to 90% by weight and an amount of the dielectric material powder is 0.2 to 1% by weight after the insulating material powder is removed by dissolution.

An average particle size of the metal powder used in the sintered porous metal body is 30 μm or less. Although the lower limit of the average particle size is not limited, it should be considered that a particle size of metal powders is generally 1 nm or more.

In the sintered porous metal body of the present invention, the volume porosity should preferably be 10 to 90%, more preferably 60 to 80%. The volume porosity may be changed in accordance with applications; for example, in filters the volume porosity of 60% or more is preferable. If the sintered porous body is used for structural applications, the volume porosity of 10 to 60% is preferable.

The mixed powder comprises the metal powder such as aluminum or aluminum alloy powder and the insulating material powder such as sodium chloride, or the metal powder such as aluminum or aluminum alloy powder and the insulating material powder such as sodium chloride and the dielectric material powder such as silicon carbide or zirconia. If a desired porosity of the sintered porous metal body is one that is a natural filling density (tap density), the addition of the insulating material powder is not necessary. In this case, addition of the dielectric material powder and the semiconductor material powder is sufficient. In addition, if a desired porosity is higher than the natural filling density, it is effective to compression mold the powder under a pressure where the oxide film of the surface of the powder is damaged. If the oxide film of the surface is damaged, new metal surfaces of the powder contact with each other so that the microwave does not enter the powder to hinder the heating of the powder.

Conditions that do not damage the oxide film of the surface of the powder depend on kinds of metals, particle sizes, shapes of particles, techniques of molding, etc. If a particle size of aluminum powder is 3 μm, the oxide film of the surface is not almost damaged under a uni-axial compression pressure of 150 MPa, which leads to satisfactorily effective heating of the powder. In case of iron based, nickel based or cobalt based powder, crystal grains tend to grow because heating temperatures are high so that there may be no typical average particle sizes. A preferable average particle size of aluminum powder is 30 μm or less, more preferably 10 μm or less.

A preferable average particle size of sodium chloride for forming the voids is 300 to 500 μm. An average particle size of the insulating powder such as silicon carbide or zirconia powder is 5 μm or less, preferably 3 μm or less, and an average particle size of powder of iron based, copper based, nickel based or cobalt based alloy is 300 μm or less, more preferably 100 μm or less. In case of semiconductor material powder of silicon, boron and germanium, an average particle size is 100 μm or less, more preferably 50 μm.

These insulating material powder and the dielectric material powder or the semiconductor material powder are mixed in an amount of 50 to 90% by weight and 1% by weight, the remainder being the metal powder, respectively. The order of mixing the powders is that at first the insulating material powder and the dielectric material powder or the semiconductor material powder are mixed, and then the metal powder and the mixed insulating material powder and the dielectric material powder or the semiconductor material powder are mixed. In order to effectively perform the heating with the microwave, the metal powder and the dielectric material powder and the semiconductor material powder, and if necessary the insulating material powder are mixed homogeneously as much as possible.

Molding of the mixed powers is performed by the uni-axial pressing, power rolling or powder extrusion at room temperature to obtain a relative density of 80% or higher, more preferably 90% or more. However, if a high density of the sintered porous metal body is not desired, the compression molding is not necessary.

Heating and sintering with the microwave is performed with micro wave or milli-wave having a wavelength of 300 MHz (wavelength: 1 m) to 300 GHz (wavelength: 1 mm), preferably microwave of 2.45 GHz or milli-wave of 28 GHz. Heating is conducted at a temperature lower than the melting point of the metal powder or a temperature lower than the liquid-phase line of the metal powder for 10 to 30 minutes. The temperature lower than the melting point of the metal powder includes the temperature lower than the liquid-phase line temperature. That is, the heating of the alloy powder can be conducted at the liquid-phase line or lower temperature.

An atmosphere is in a higher vacuum than 10 Pa (a reduced pressure lower than 10 Pa, preferably lower than 5 Pa), or in an atmospheric pressure of inert gas, nitrogen gas, hydrogen gas or their mixtures.

The sodium chloride is removed by dissolving in hot water with an ultrasonic washing after sintering to obtain the porous body.

The present invention will be explained in detail in the following. The particle size of aluminum powder as the metal powder is smaller than that of sodium chloride as the insulating material powder by about one digit. The particle size of the silicon carbide or zirconia as the dielectric material powder is further smaller than that of the aluminum powder by about one digit.

Among the additive amounts of the powders, an amount of sodium chloride is dominant because the sodium chloride powder finally forms voids. However, if the amount exceeds 90% by weight, an amount of aluminum powder that constitutes a skeleton of the porous body becomes insufficient and the structure is not formed. Since silicon carbide is an assistant for heat generation, an amount thereof is 1% by weight at most.

At first, silicon carbide powder is dispersed on sodium chloride powder by mixing. Then, the mixture of the silicon carbide and the sodium chloride is mixed with aluminum powder to sufficiently cover the sodium chloride powder with aluminum powder.

The molding of the powder mixture is conducted at room temperature by the uni-axial pressing with a graphite mold. In order to scale up the production, sheets by powder rolling or wires by powder extrusion may be employed. The relative density of the molding should be made as high as possible, preferably to be 80% or more for practical use, more preferably to be 90% or more.

In the molding, respective powders contact each other and the aluminum powder covering the sodium chloride deforms by shearing so that sodium chloride powder may contact. As a result, open pores are formed after dissolving the sodium chloride out from the molding. If the pressing pressure is elevated, a distance between the powders becomes smaller, and the aluminum powder is deformed by shearing to thereby break the native oxide film so that aluminum powder contacts with metallurgical contact to accumulate strain energy.

A microwave heating furnace is a widely used one, which is a multi-mode type of 2.45 GHz. Particularly, for manufacturing wires, a high heating efficient is expected if a 2.45 GHz single mode (magnetic field) is used.

Further, in case of heating large sized moldings, a continuous furnace is used rather than a batch furnace. As a heating atmosphere and pressure, it is necessary not to generate microwave induced plasma. In addition, a pressure sintering may be employed. The moldings are covered with a heat insulator to prevent transfer heat, which spontaneously generates. Further, if radiation of heat is remarkable, aluminum powder mixture is coated on an insulator, which may be used as a warm keeper.

When a microwave is irradiated to the molding, the aluminum powder generates heat by absorption of microwave. Since sodium chloride transmits microwave, it does not generates heat. Silicon carbide and zirconia strongly absorb microwave to generate remarkable heat.

In the moldings employed in the present invention, aluminum powder of the metal phase and sodium chloride powder of the insulating phase respectively contact each other. That is, the aluminum skeleton and sodium chloride skeleton are hypothetically combined.

When a microwave is irradiated to the moldings, since sodium chloride is transparent to the microwave, the microwave can enter the aluminum skeleton. Since silicon carbide powder is present at the outermost face of the aluminum skeleton, the microwave is absorbed in the silicon carbide powder at first to generate heat. At the same time, the aluminum powder generates heat by virtue of the skin effect, and heat generated in the silicon carbide powder and the aluminum powder sinters the aluminum skeleton. The present invention utilizes effectively the difference in reciprocal action between substances and the microwave, i.e. selective heating.

In the iron based, copper based, nickel based or cobalt based alloys, there are such cases where an increase in the porosity by means of the insulating material powder is not necessary from the view points of applications. In this case, it is possible to effectively manufacture sintered porous metal bodies by simply mixing predetermined amounts of the dielectric material powder or semiconductor material powder as a susceptor. The susceptor is added in an amount of about 1% by weight at most. When silicon carbide or zirconia as the dielectric material powder, these are heated more effectively in an electric field.

On the other hand, the metal powder is effectively heated in magnetic field. The insulating material powder such as sodium chloride is effectively heated in electric field. In case of sintering of the iron based, copper based, nickel based or cobalt based alloy powder, sintering at 1000° C. or higher is conducted. Change of dielectric constant and dielectric tangent loss are large at such high temperatures. Since the metal powder and the dielectric material powder are different in their functions, temperature control at the high temperature is difficult in heating the mixtures.

On the other hand, semiconductor material powder such as carbon, silicon, germanium, etc can be heated in electric field or in magnetic field, and therefore, it is possible to control a heating level by adjusting particle sizes thereof. Accordingly, the semiconductor material powder is preferred as a heating assisting agent. However, it should be considered that the semiconductor material powder may react with the metal powder. For example, if carbon is used as a susceptor for sintering the iron based material, carbon may diffusion into iron material. Accordingly, it is preferable to select such combination that the substance to be sintered and the susceptor hardly react with each other. However, if a reaction product is not a compound that remarkably absorbs microwave or if a particle size and additive amount are controlled to be a combination that effectively exhibits a function of heating assisting agent, even if a part of the susceptor react with the metal, desired porous bodies are obtained.

A microwave heating furnace of 2.45 GHz multimode furnace or a single mode furnace is suitable for iron based, copper based, nickel based and cobalt base alloys because the sintering temperature is high. In case of large scaled moldings, a continuous furnace is more suitable than a batch furnace. In selecting a heating atmosphere and pressure, it is necessary to avoid microwave induced plasma. A pressure sintering may be used. The moldings are covered with a heat insulator to prevent spontaneous heat from transferring to outside.

Example 1

Pure aluminum powder having a particle size of less than 3 μm and sodium chloride having a particle size of about 500 μm were mixed with a ball mill at a weight ratio of 1:3 to obtain a mixed powder. Then, the mixed powder was put in a graphite mold having an inner diameter of 10 mm and was pressed with a graphite punch to obtain a molding. A molding pressure was 200 MPa, and a relative theoretical density was 95%. Further, the molding was set in a microwave heating furnace (frequency: 2.35 GHz) together with a thermal insulator made of alumina. After a chamber was evacuated to vacuum, the chamber was purged with nitrogen gas to atmospheric pressure. While a temperature of the mold is being measured with a radiation thermometer, the molding was heated by irradiating the molding with a magnetic field by means of a single mode microwave furnace (output: not greater than 1 kW) for 20 minutes. After holding the molding at 450° C. for 10 minutes, the microwave output was stopped and the molding was cooled in the furnace. After sintering, the molding was subjected to ultrasonic washing in hot water to dissolve the sodium chloride out to remove it.

Example 2

Pure aluminum powder having a particle size of less than 3 μm and sodium chloride powder having a particle size of about 500 μm at a mixing ratio of 1:3 and silicon carbide powder having a particle size of 2 to 3 μm in an amount of 0.2% by weight were weighed.

Figure 2:
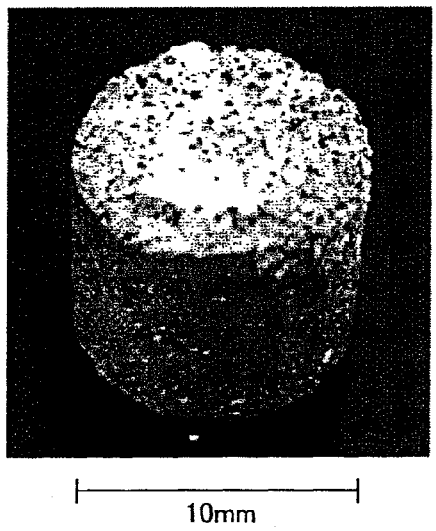
FIG. 2 is a photograph of a sintered porous metal body prepared in example 2.

The sodium chloride powder and the silicon carbide powder were mixed with a ball mill, and the aluminum powder was added to the mixed powder to obtain a mixed powder. The mixed powder was molded in the same manner as in example 1 to obtain a molding. Thereafter, the molding was subjected to irradiation of electric field and magnetic field at 2:8 with a microwave furnace (output: not greater than 1 kW) to heat the molding at an elevation speed of 100° C./min. After holding the molding at 650° C. for 10 minutes, a microwave output was stopped and the molding was cooled in the furnace. After sintering the molding was subjected to ultrasonic washing in hot water to remove the sodium chloride to obtain aluminum porous body having a porosity of 79% (FIG. 2). According to this method, if the molding is done by a uni-axial molding, a near net shape molding is obtained.

Example 3

Pure aluminum powder having a particle size of less than 3 μm and sodium chloride powder having a particle size of about 500 μm at a mixing ratio of 1:3 and silicon carbide powder having a particle size of 2 to 3 μm in an amount of 0.2% by weight were weighed.

After the sodium chloride powder and the silicon carbide powder were mixed with a ball mill, aluminum powder was added to further mix them. Then the mixed powder was put in a graphite mold having an inner diameter of 30 mm, and the mixed powder was molded w graphite punch at a molding pressure of 145 MPa to obtain a molding having a relative theoretical density of 89%. The molding was set in a milliwave heating furnace (frequency: 28 GHz) together with a thermal insulator made of alumina.

Figure 3:
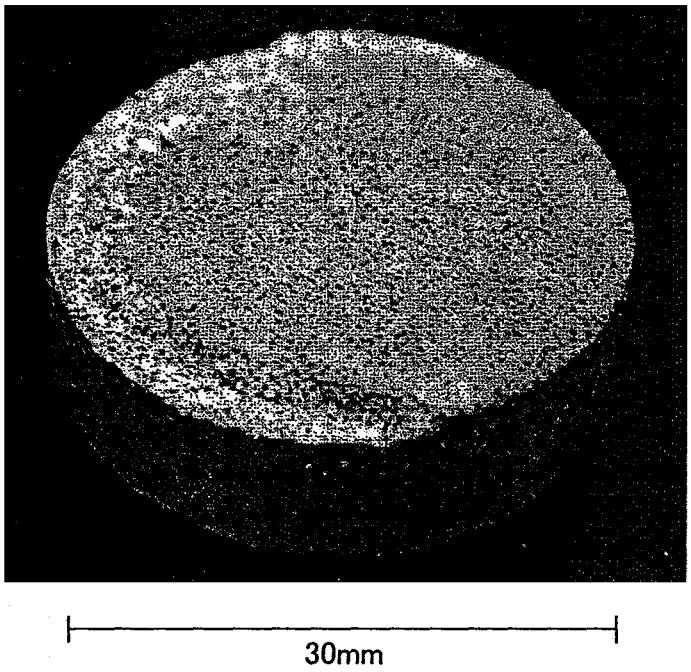
FIG. 3 is a photograph of a sintered porous metal body prepared in example 3.

After the chamber was evacuated, the chamber was purged with nitrogen gas to an atmospheric pressure. While a temperature of the molding was being measured, milli-wave was applied at an output of not greater than 1 kW at a temperature elevation speed of 40° C./min. After the heating, the molding was held at 630° C. for 10 minutes. Thereafter, the milli-wave was stopped to cool the molding in the furnace. After sintering, the molding was subjected to ultrasonic washing in hot water to remove the sodium chloride to obtain aluminum porous body with a porosity of 61% (FIG. 3).

Example 4

Manufacturing of large sized sintered porous sheets was tried in accordance with examples 1 to 3.

Figure 4:
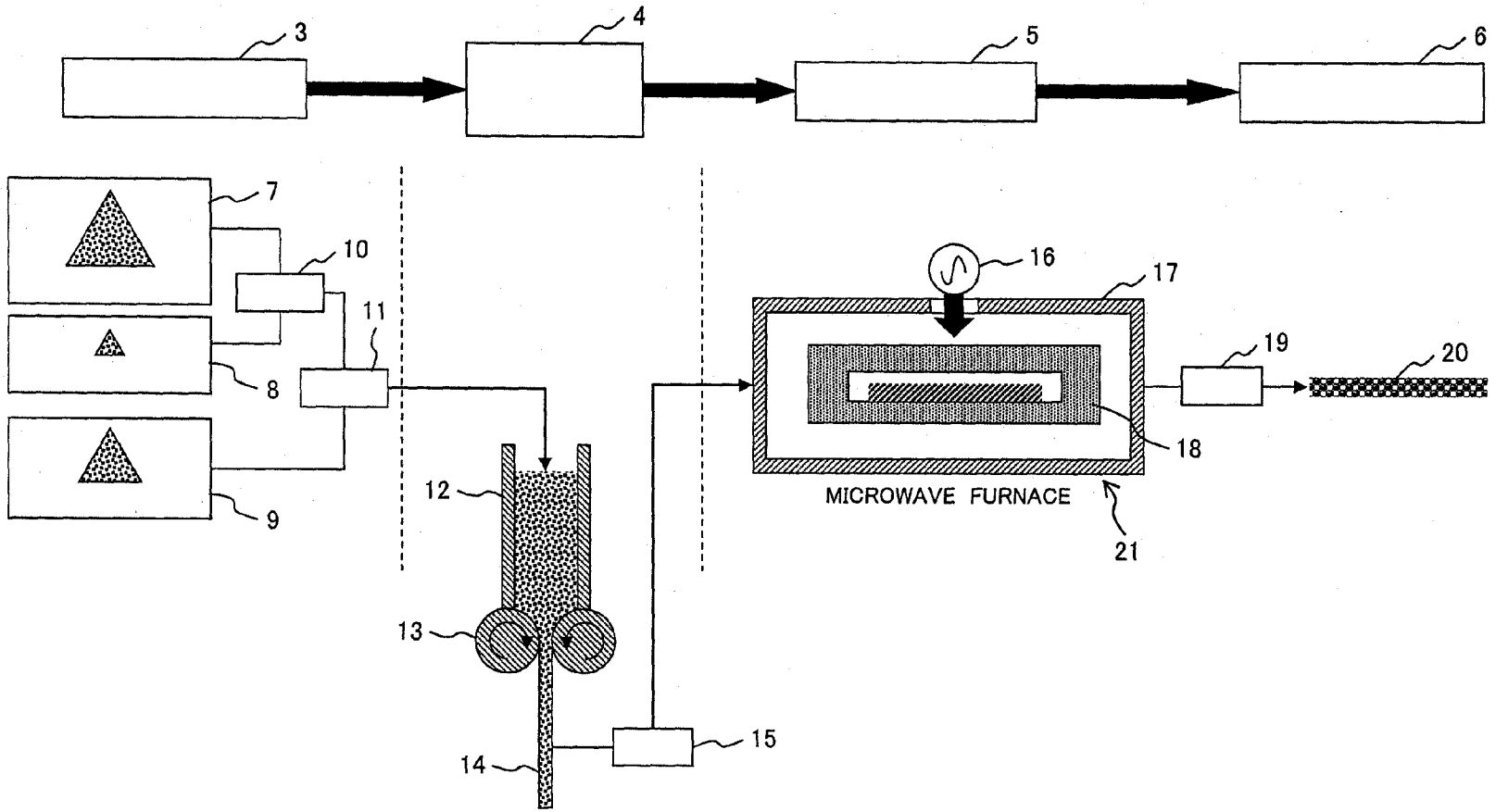
FIG. 4 is a flow chart showing a process for manufacturing a large-scale porous sheet according to the present invention.

FIG. 4 shows a flow chart of a method of manufacturing a large sized porous sheet according to the present invention.

(1) A weighing and mixing step 3: Aluminum alloy powder 9 of A 5083 having a particle size of not larger than 5 μm and sodium chloride power 7 having a particle size of about 500 μm at a mixing ratio of 1:2 by weight and silicon carbide 8 having a particle size of 2 to 3 μm in an amount of 0.5% by weight were weighed. At first, the sodium chloride powder 7 and the silicon carbide powder 8 were mixed with a ball mill to obtain a mixed powder 10. Thereafter, aluminum powder 9 was added to the mixed powder 10 to further mix them to obtain a mixed powder 11.

(2) A powder molding step 4 (powder rolling): Next, the mixed powder 11 was charged in a hopper 12 above a powder rolling mill, followed by rolling with a roller 13 to a rolling rate of 80%. The resulting rolled member 14 had a width of 100 mm, a thickness of 5 mm and a relative theoretical density was about 100%.

(3) A microwave sintering step 5: The powder rolled member 14 was cut into a desired size (a length: 100 mm) at 15, and the cut member was set in a microwave heating furnace 21 (frequency: 2.45 GHz) in a state that the member was sandwiched between thermal insulators 18 made of alumina. The chamber was evacuated to vacuum, and the chamber was purged with nitrogen gas to an atmospheric pressure.

While the temperature of the member was being measured, microwave (output: not larger than 3 kW) was applied from a microwave generator 16 to heat at an elevation speed of 50° C./min, followed by holding it at 550° C. for 10 minutes. Thereafter, the output of the microwave was stopped to cool the member in the furnace.

(4) A preparation of a porous sheet step 6: After sintering, the member was subjected to ultrasonic washing in hot water to remove sodium chloride.

Figure 5:
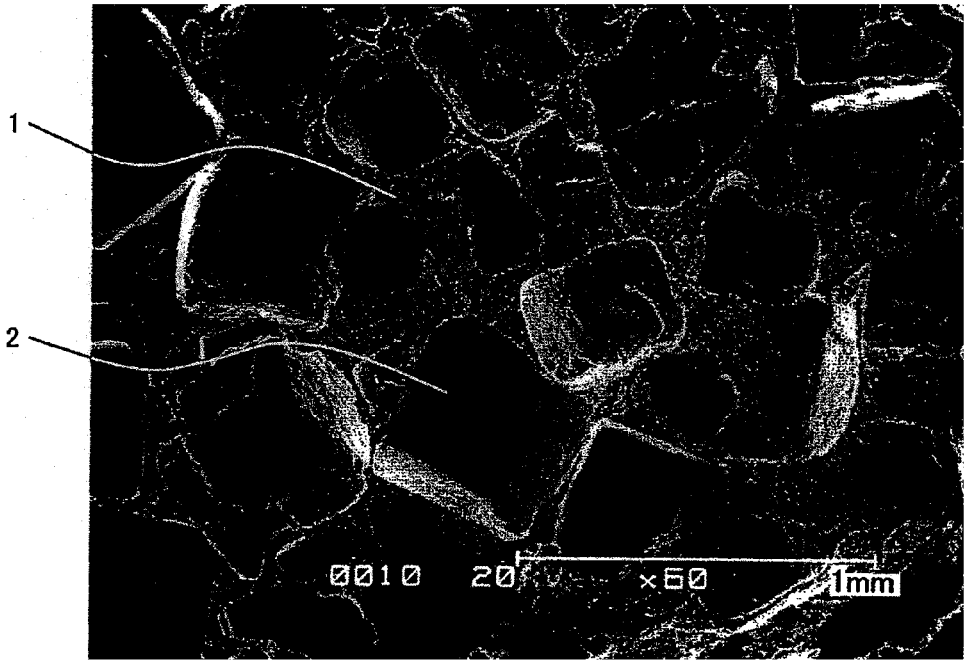
FIG. 5 is a photograph showing an inner structure of a sintered porous body prepared in example 4.

FIG. 5 shows a microscopic photograph of the interior of the aluminum porous sheet (sintered porous metal body) prepared in the above mentioned method. As shown in this figure, the aluminum porous sheet comprises aluminum skeleton 1 and cubic form voids 2 each having one side length of about 500 μm. An average porosity was 65%. The particle size of crystals of aluminum constituting the aluminum skeleton 1 was about 20 μm.

In this example, since a batch type microwave heating furnace was used, the rolled member was sintered after the rolled member was cut into a desired size because of limitation of the furnace size. However, if a continuous microwave heating furnace is used, it is possible to manufacture a long, strip porous sheet. As a result, it is possible to scale up the production scale.

In this example, since sodium chloride was used as an insulating material, the shape of the voids is cubic form, but the shape of the voids is not limited to the cubic form. Any insulating material powder that transmits microwave may be used regardless of the shape of the voids may be used for aluminum porous sheet.

Example 5

Low carbon content iron powder having an average particle size of about 50 to 150 μm and carbon powder as semiconductor material powder were heated by 1 kW with a microwave single mode furnace of 2.45 GHz in a magnetic field. The powders were compacted by self-gravity in a quartz crucible under a vibration without outer pressure. The crucible was covered with a thermal insulator of alumina to prevent heat radiation. Temperature was measured by a radiation thermometer.

When mono atomic molecular gas such as Ar or He was used as atmospheric gas, discharge took place at a temperature higher than 800° C. so that temperature control was impossible to continue heating. On the other hand, when multiple atomic molecular gas such as $N_2$ or $CO_2$ was used as atmospheric gas, discharge was prevented. An atmospheric gas pressure was the normal pressure, and gas was flown during the processing.

When the sample was processed in vacuum, discharge took lace when a vacuum degree was 10-3 Pa or higher so that homogeneous heating was impossible. However, when the vacuum degree was lower than 10-3 Pa, discharge was prevented.

Results of microwave heating are shown in Table 1. The results are related to data wherein $N_2$ was used. When the multiple atomic gas molecule such as $CO_2$ etc was used, the similar results were obtained.

TABLE 1

| Metal powder | Semiconductor powder | Particle size of semiconductor powder (μm) | Maximum temperature (° C.) | Sintering state |
|---|---|---|---|---|
| Fe (Low carbon steel) | C | 10 | 1422 | Partial melting |
| | | 20 | 1289 | Good |
| Co | C | 10 | 1410 | Good |
| | | 20 | 1272 | Not sintered |
| Ni | C | 10 | 1413 | Good |
| | | 20 | 1280 | Not sintered |

TABLE 1-continued

| Metal powder | Semiconductor powder | Particle size of semiconductor powder (μm) | Maximum temperature (° C.) | Sintering state |
|---|---|---|---|---|
| Cu | C | 50 | 955 | Good |
| | | 100 | 678 | Not sintered |
| | B | 100 | 980 | Good |
| Al | C | 50 | 709 | Melting |
| | | 100 | 650 | Good |
| | Ge | 100 | 510 | Good |
| | Si | 75 | 523 | Good |

In the following, the results in Table 1 will be explained. In the case where nothing was added to low carbon steel powder having a particle size of 50 μm, it was possible to heat rapidly to 800° C., which is close to the Curie point. However, sintering did not take place, and porous body could not be obtained because of collapse during handling.

Next, when carbon powder (graphite+amorphous carbon) having particle sizes of 10 μm and 20 μM in an amount of 1% by weight was added to the low carbon steel powder, it was possible to heat the packed powder to 1400° C. in case of carbon powder of 10 μm and to heat the powder to 1300° C. in case of 20 μm. Although the packed powder was partially sintered in case of 10 μm carbon powder, a partial melting was observed.

On the other hand, the packed powder was heated to 1300° C. in case of 20 μm carbon powder, and even a trace of melting was not observed to obtain good porous body. The structures of the packed powder after heating were that in case of 10 μm carbon powder, almost all carbon powder added disappeared as a result of reaction with low carbon steel, but in case of 20 μm carbon powder, the added carbon powder remained though a part of carbon powder reacted with the low carbon steel.

Example 6

Cobalt powders and nickel powders to which 10 μm carbon powder and 20 μm carbon powder in an amount of 1% by weight were added were heated in the same manner as in the low carbon steel in example 5. The samples in case of addition of 10 μm carbon powder were heated to 1400° C., and The samples in case of addition of 20 μm carbon powder were heated to 1300° C. Good sintered porous bodies were obtained from the samples of cobalt and nickel powders in case of 10 μm carbon powder, but in case of the samples of cobalt and nickel powders with 20 μm carbon powder, almost no sintering took place. The structures of the samples were that 10 μm carbon powder and 20 μm carbon powder did not react with cobalt powder and nickel powder so that added carbon powder remained in the same status as added.

Example 7

Carbon powders of 50 μm and 100 μm were added to copper powder and aluminum powder each having a particle size of 50 to 150 μm at an amount of 1% by weight, and then, the samples were irradiated with microwave at an output of 0.7 kW in the same manner as in the low carbon steel. In case of 50 μm carbon powder, the samples were heated to about 1000° C., and in case of 100 μm carbon powder, the samples were heated to 600° C. In case of 50 μm carbon powder, the sample of copper powder produced a good porous body, but the sample of aluminum powder badly melted partially. On the other hand, in case of 100 μm carbon powder, the sample of copper powder did not sinter, but the sample of aluminum produced a good porous body.

Example 8

As other semiconductor material powders, boron, germanium and silicon were used to confirm if sintered porous bodies are obtained. Boron powder having a particle size of 100 μm was added to copper powder, germanium powder having a particle size of 100 μm and silicon powder having a particle size of 75 μm were added to aluminum powder, and the samples were heated. Good sintered porous bodies were obtained in case of boron and germanium of 100 μm to copper powder and silicon powder of 75 μm to aluminum powder.

Since the semiconductor material powders generate heat under the influence of electric field and magnetic field, sintering is accelerated. In addition, addition of the semiconductor material powders makes it easy to control temperature. In the above examples, any semiconductor material powders provided good sintered porous bodies, though there were differences depending on particle sizes and kinds of semiconductors.

The sintered porous metal bodies can be utilized in mechanical parts, electrical parts and structural members such as lubricating parts, electro-conductive parts, heat-conducting parts, catalysts or carriers for catalysts, light weight structuring members, etc. The method of manufacturing the porous bodies can be applied to net shaping molding or near net shaping molding.

The sintered porous metal bodies can be applied to different functioning members such as filters, dampers, high energy absorbents, lubricating members, bearing members. The method of manufacturing the porous members can produce easily homogeneous sintered porous bodies and scale up of the production is easy.

What is claimed is:

1. A sintered porous metal body, which has a sintered structure having a volumetric porosity of 61 to 90%, wherein there is at least one kind of powder particles selected from the group consisting of dielectric material powders and semiconductor material powders that absorb energy of electromagnetic wave having a frequency of 300 MHz to 300 GHz among metal crystalline particles constituting the sintered body, wherein the particles are substantially homogeneously dispersed in the sintered body, wherein the metal crystalline particles are sintered with pores formed by removing spacer powder therefrom, and wherein the metal crystalline particles are formed from aluminum or aluminum alloy powder.

2. The sintered porous metal body according to claim 1, wherein the particles are dispersed in the metal crystalline particles.

3. The sintered porous metal body according to claim 1, wherein the pores have a cubic form.

4. The sintered porous metal body according to claim 1, wherein the pores have an undefined form.

5. The sintered porous metal body according to claim 1, wherein the dielectric material powder is a member selected from the group consisting of silicon carbide, silicon nitride, aluminum nitride and zirconia.

6. The sintered porous metal body according to claim 1, wherein an average particle size of the dielectric material powder and/or semiconductor material powder is 5 μm or less.

7. The sintered porous metal body according to claim 1, wherein an amount of the dielectric material powder or the semiconductor material powder is 0.4 to 10% by weight per weight of the metal powder.

8. The sintered porous metal body according to claim 1, wherein the particle size of the metal powder is 30 μm or less.

9. The sintered porous metal body according to claim 1, wherein the volumetric porosity of the sintered body is 61 to 82%.

* * * * *